US010101112B2

(12) United States Patent
Lee

(10) Patent No.: US 10,101,112 B2
(45) Date of Patent: Oct. 16, 2018

(54) LAUNCHING APPARATUS USING ROTATING MAGNETIC BODY

(71) Applicants: Young Taek Lee, Seoul (KR); CRITICAL FACILITY SERVICE CORPORATION, Seoul (KR)

(72) Inventor: Young Taek Lee, Seoul (KR)

(73) Assignee: CRITICAL FACILITY SERVICE CORPORATION, Seoul (KR)

( * ) Notice: Subject to any disclaimer, the term of this patent is extended or adjusted under 35 U.S.C. 154(b) by 0 days.

(21) Appl. No.: 15/573,689

(22) PCT Filed: May 11, 2016

(86) PCT No.: PCT/KR2016/004907
§ 371 (c)(1),
(2) Date: Jan. 15, 2018

(87) PCT Pub. No.: WO2016/182327
PCT Pub. Date: Nov. 17, 2016

(65) Prior Publication Data

US 2018/0245877 A1 Aug. 30, 2018

(30) Foreign Application Priority Data

May 13, 2015 (KR) ..... 10-2015-0066710

(51) Int. Cl.
*F41B 6/00* (2006.01)
*F42B 6/00* (2006.01)

(52) U.S. Cl.
CPC ..... *F41B 6/003* (2013.01); *F42B 6/006* (2013.01)

(58) Field of Classification Search
CPC ..... F41B 6/00; F41B 6/003; F41B 6/006
See application file for complete search history.

(56) References Cited

U.S. PATENT DOCUMENTS

| | | | | |
|---|---|---|---|---|
| 4,913,030 | A | 4/1990 | Reynolds | |
| 5,699,779 | A * | 12/1997 | Tidman | F41B 3/04 124/1 |
| 7,614,393 | B1 * | 11/2009 | Lu | F42B 6/006 124/3 |
| 2009/0314269 | A1 * | 12/2009 | Victor | F41B 6/00 124/3 |
| 2017/0343314 | A1 * | 11/2017 | Hartman | F41B 6/003 |

FOREIGN PATENT DOCUMENTS

| | | | | |
|---|---|---|---|---|
| CN | 104019697 A | | 9/2014 | |
| GB | 2206677 A | * | 1/1989 | F41B 6/006 |
| JP | 2001-133198 A | | 5/2001 | |
| WO | WO-2006088584 A2 | * | 8/2006 | B64G 1/002 |

* cited by examiner

*Primary Examiner* — Gabriel J. Klein
(74) *Attorney, Agent, or Firm* — KORUS Patent, LLC; Seong Il Jeong

(57) ABSTRACT

The present invention relates to a launching apparatus and, more particularly, to a launching apparatus using a revolving magnetic body, wherein the apparatus is safe and is capable of being driven with low power consumption, the apparatus including: an acceleration pipe formed by spirally winding a hollow pipe made of a non-magnetic material; a stator wound with a plurality of coils to encompass an outside of the acceleration pipe, and forming a magnetic field by being magnetized when an electric current is applied thereto; and a magnetic body launched outside after revolving along a circumference of the acceleration pipe due to a force exerted thereto by the magnetic field.

7 Claims, 9 Drawing Sheets

LAUNCHING APPARATUS USING ROTATING MAGNETIC BODY

TECHNICAL FIELD

The present invention relates generally to a launching apparatus and, more particularly, to a launching apparatus using a revolving magnetic body, the apparatus being driven with low energy consumption.

BACKGROUND ART

In general, a launching apparatus or an injecting apparatus is an apparatus used for launching or injecting an object such as launching a bullet, a rocket, etc. from a military weapon such as a gun, a rocket, etc., and injecting sand, steel powder, paint, etc.

Such a launching apparatus or an injecting apparatus uses explosive gas due to gunpowder or uses compressed air to launch or inject an object. However, use of the gunpowder has a high risk that a user may be injured, and use of the compressed air requires high energy consumption, which is not economical.

DOCUMENTS OF RELATED ART (Patent Document 1) Korean Patent Application Publication No. 10-2011-0146723 (LAUNCHING APPARATUS OF AN OBJECT)

DISCLOSURE

Technical Problem

Accordingly, the present invention has been made keeping in mind the above problems occurring in the prior art, and an object of the present invention is to provide a launching apparatus using a revolving magnetic body, wherein the apparatus is safe and is capable of being driven with low power consumption and thus is economical.

Technical Solution

In order to accomplish the above object, the present invention provides a launching apparatus using a revolving magnetic body, the apparatus including: an acceleration pipe formed by winding a hollow pipe made of a non-magnetic material; a stator wound with a plurality of coils to encompass an outside of the acceleration pipe, and forming a magnetic field by being magnetized when an electric current is applied thereto; and a magnetic body launched outside after revolving along a circumference of the acceleration pipe due to a force exerted thereto by the magnetic field.

Advantageous Effects

As described above, according to the present invention, since the magnetic body is launched after revolving by the magnetic field formed by the magnetized stator, there is no need to use the gunpowder or compressed air for launching the magnetic body, thereby ensuring safety. In addition, it is possible to launch the magnetic body at high speed while minimizing energy consumption, thereby enabling increased utilization in various fields.

BEST MODE

The present invention provides a launching apparatus and, more particularly, to a launching apparatus using a revolving magnetic body, wherein the apparatus is safe and is capable of being driven with low power consumption, the apparatus including: an acceleration pipe formed by spirally winding a hollow pipe made of a non-magnetic material; a stator wound with a plurality of coils to encompass an outside of the acceleration pipe, and forming a magnetic field by being magnetized when an electric current is applied thereto; and a magnetic body launched outside after revolving along a circumference of the acceleration pipe due to a force exerted thereto by the magnetic field.

Before the present invention is described in detail, it should be noted that the scope of the present invention is not limited to the embodiments described below, and those skilled in the art will appreciate that various modifications, additions and substitutions are possible, without departing from the scope and spirit of the invention.

Hereinafter, the launching apparatus using the revolving magnetic body according to the present invention will be described in detail with reference to FIGS. 1 to 9.

Figure 1:
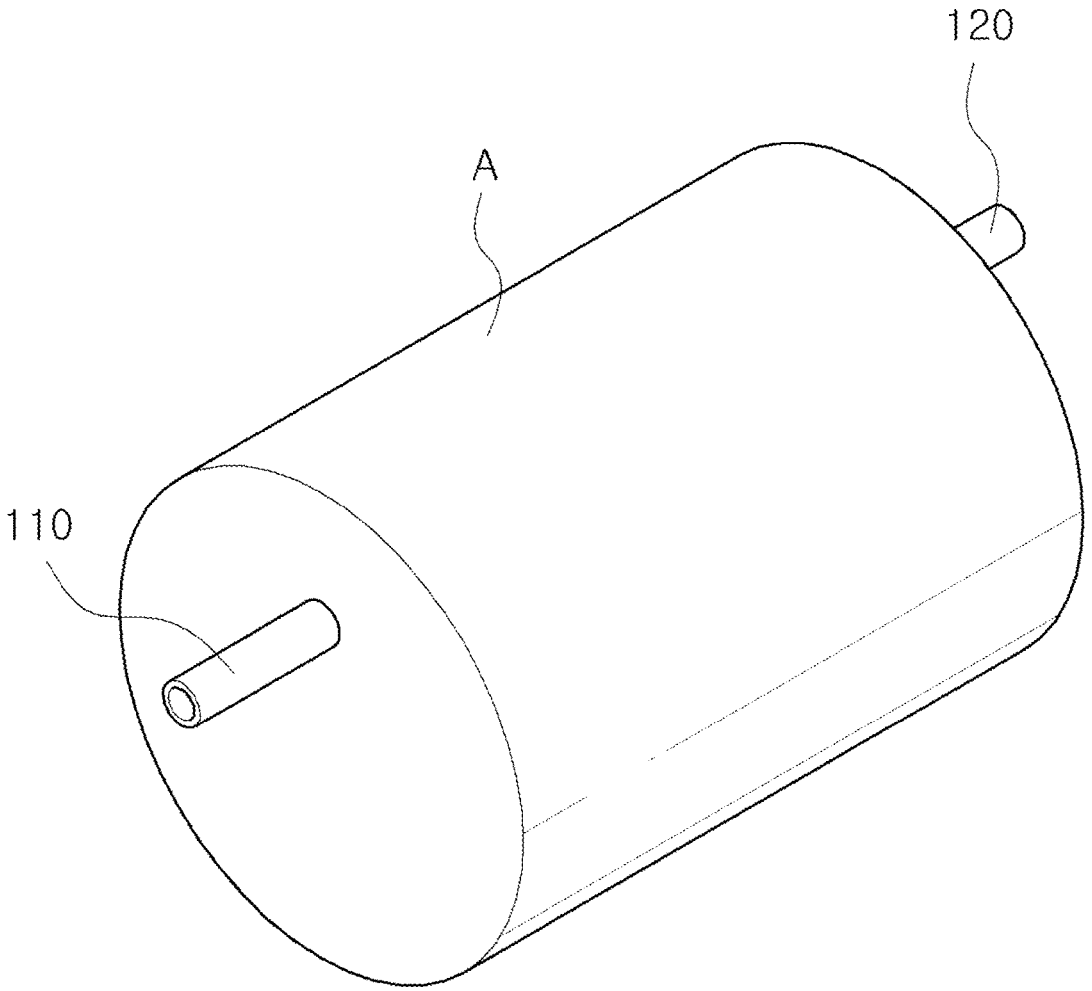
FIG. 1 is a perspective view showing a structure of a launching apparatus according to the present invention.
Figure 2:
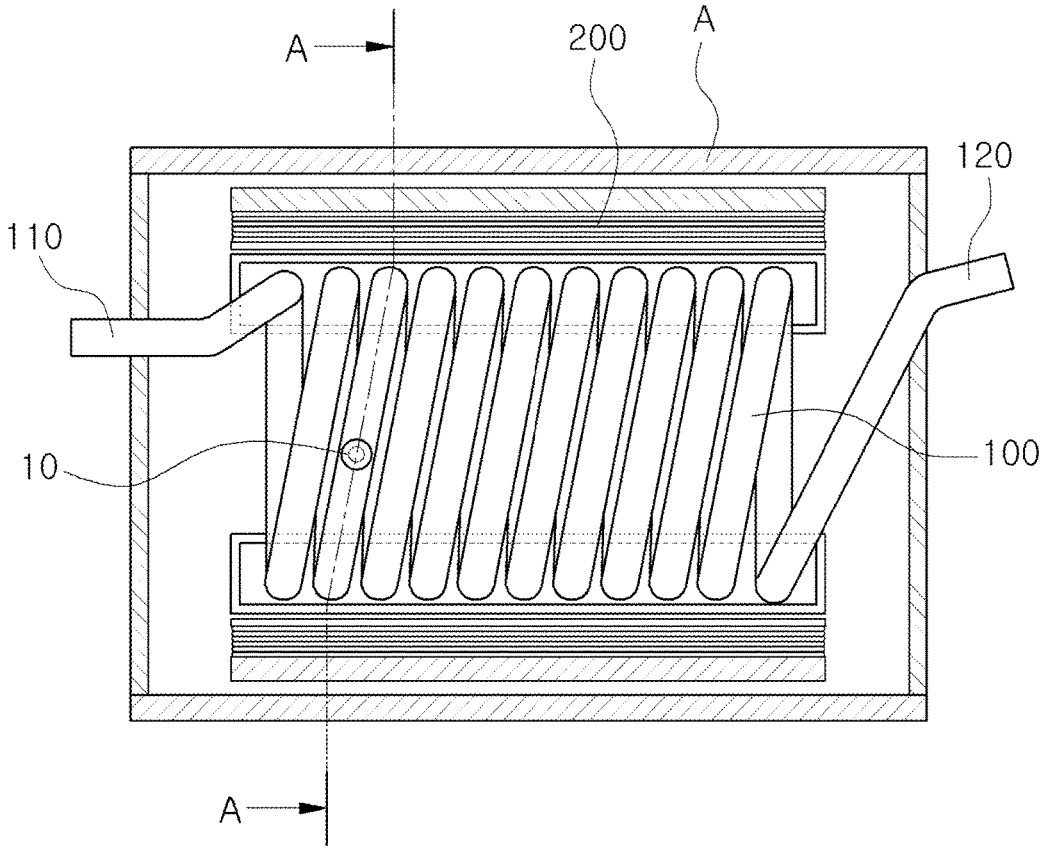
FIG. 2 is a side cross-sectional view showing the structure of the launching apparatus according to the present invention.
Figure 3:
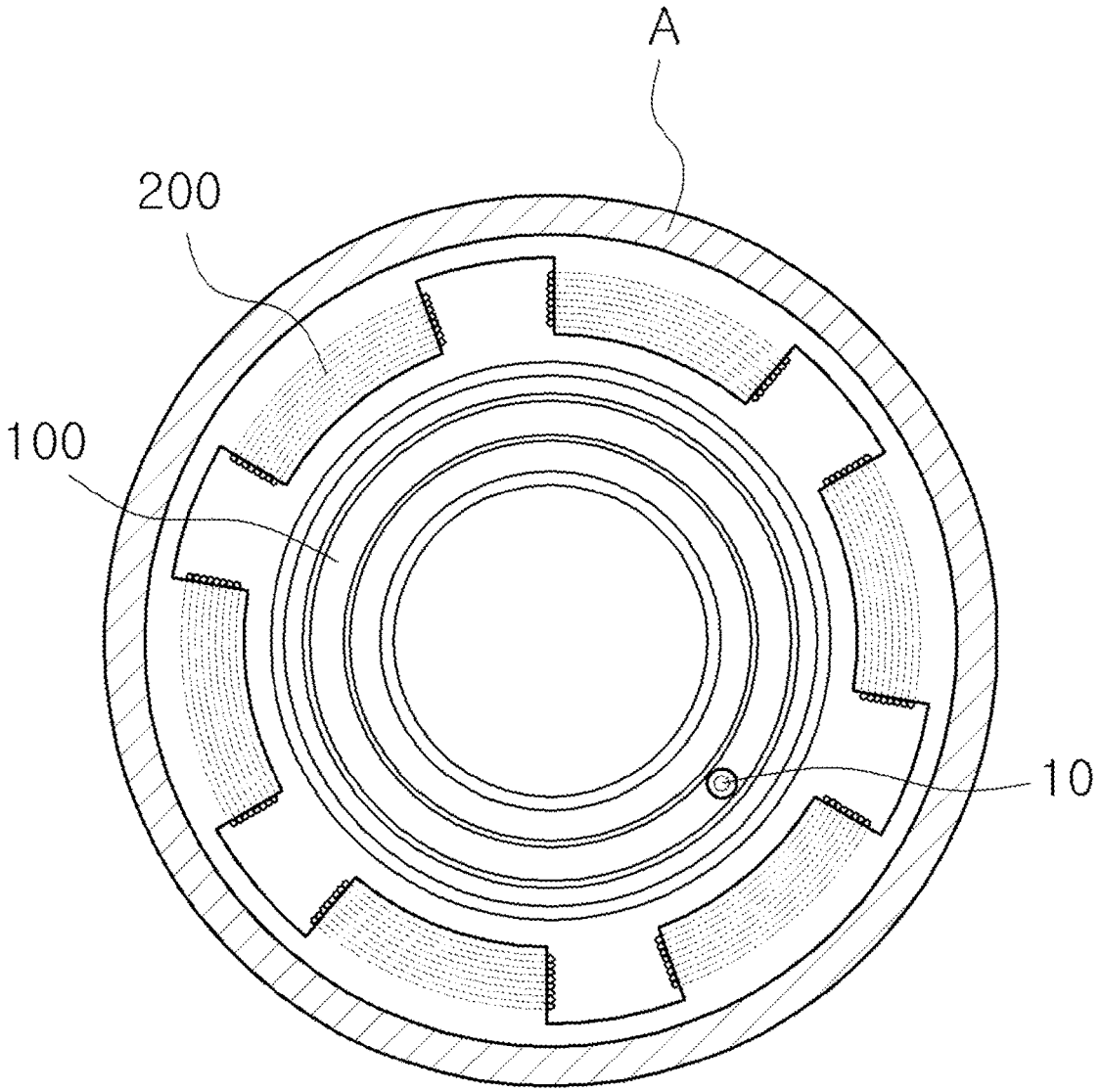
FIG. 3 is a cross-sectional view taken along line A-A showing the launching apparatus according to the present invention.

As shown in FIGS. 1 to 3, the launching apparatus using the revolving magnetic body according to the present invention includes the acceleration pipe 100 formed by spirally winding a hollow pipe, the stator 200 provided to encompass the outside of the acceleration pipe 100, and the magnetic body 10 provided in or inserted into the acceleration pipe 100.

More specifically, the acceleration pipe 100 may be made of the non-magnetic material such that the acceleration pipe is prevented from influence from the magnetic field, and may have a spiral wound shape such as a solenoid because the magnetic body 10 is provided in or inserted into the acceleration pipe 100 and revolves along the circumference thereof.

Figure 4:
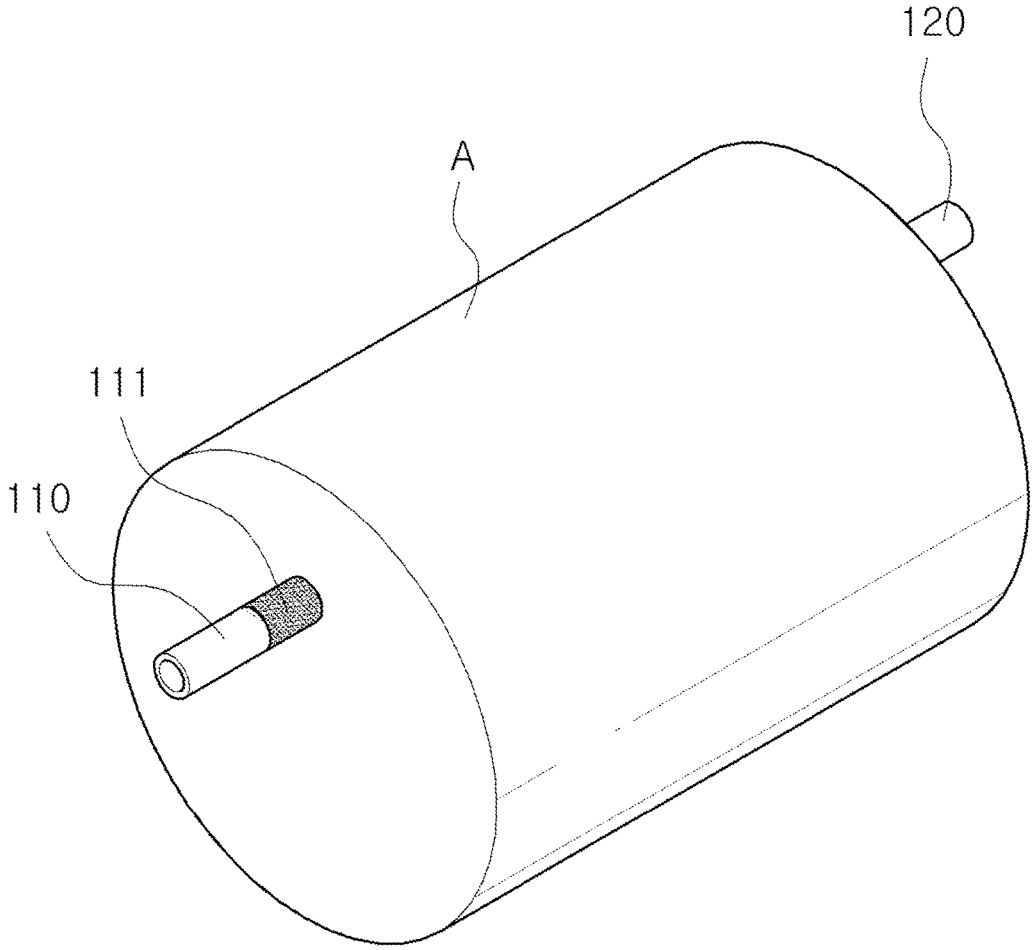
FIGS. 4 and 5 are views showing that a certain portion of an outlet pipe applied to the launching apparatus according to the present invention is made of a flexible material.
Figure 5:
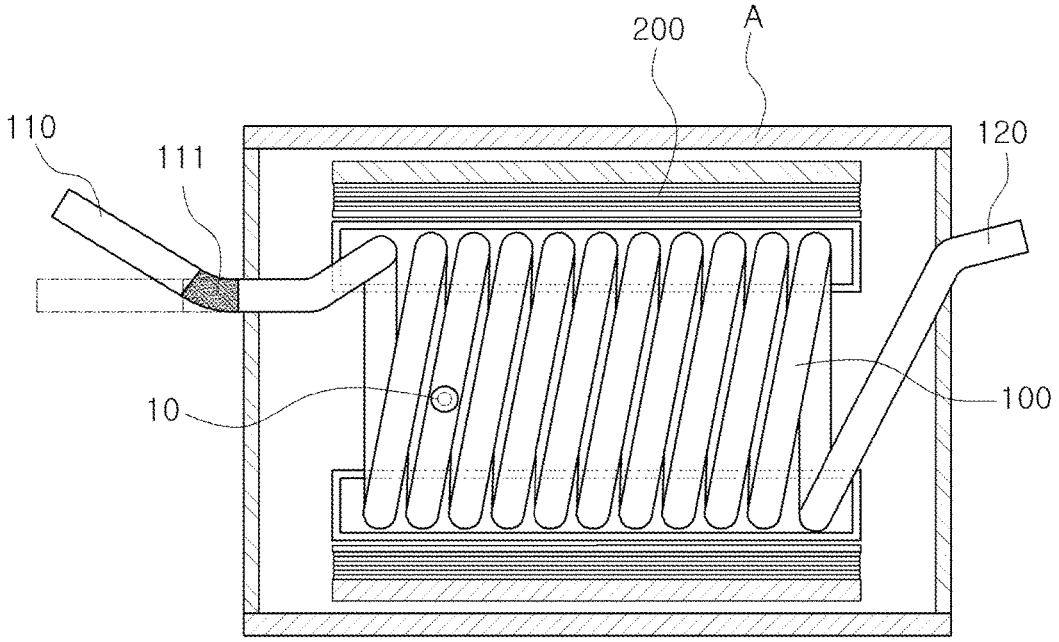

In addition, the acceleration pipe 100 is provided at a first end thereof with an outlet pipe 110 through which the magnetic body 10 is launched outside. When the magnetic body 10 is not provided in the acceleration pipe 100, the acceleration pipe is provided at a second end thereof with an inlet pipe 120 into which the magnetic body 10 is inserted. Further, the outlet pipe 110 may be provided with a helical groove formed on an inner surface thereof such that the magnetic body 10 can be launched in a correct direction. Moreover, as shown in FIGS. 4 and 5, a certain portion 111 of the outlet pipe 110 may be made of a flexible material such that the outlet pipe 110 is directed to a desired launching direction of the magnetic body 10.

The stator 200 is wound with the plurality of coils, and forms a magnetic field by being magnetized when an electric current is applied thereto. The stator may be provided on an inner surface of a housing A including therein the acceleration pipe 100 and the stator 200. Specifically, as shown in FIGS. 2 and 3, a plurality of stator cores protruding inward to encompass the outside of the acceleration pipe 100 is provided on the inner surface of the housing A, and the respective stator cores are wound with the coils, thereby constituting the stator 200.

The coils wound on the respective stator cores constituting the stator 200 form one pole. In order for the magnetic body 10 to revolve along the circumference of the acceleration pipe 100, the pole is formed of 2n (n=integer) in number. Thus, a user can adjust the number of the poles in consideration of the use of the present invention and the like.

For example, when the electric current applied to the stator 200 is an alternating current (AC) having a frequency of 60 Hz, the number of revolutions of the magnetic body 10 is derived from a formula "120×frequency/number of poles of stator". Accordingly, when the alternating current having the frequency of 60 Hz is applied as described above, depending on the number of poles of the stator 200, the magnetic body 10 passes through the inside of the acceleration pipe 100 after revolving at 3600 revolutions per minute in the case of two poles in number, at 1800 revolutions per minute in the case of four poles in number, and 1200 revolutions per minute in the case of six poles in number.

Further, the present invention may further include a regulator for regulating the frequency of the electric current applied to the stator 300. As the frequency of the electric current is increased by the regulator in response to the formula for deriving the number of revolutions of the magnetic body 10, the magnetic body 10 revolves at high speed in the acceleration pipe 100 along the circumference thereof.

Thus, it is possible to adjust speed of revolution of the magnetic body 10 by adjusting the number of poles of the stator 200 or/and the frequency of the electric current applied to the stator 200.

Figure 6:
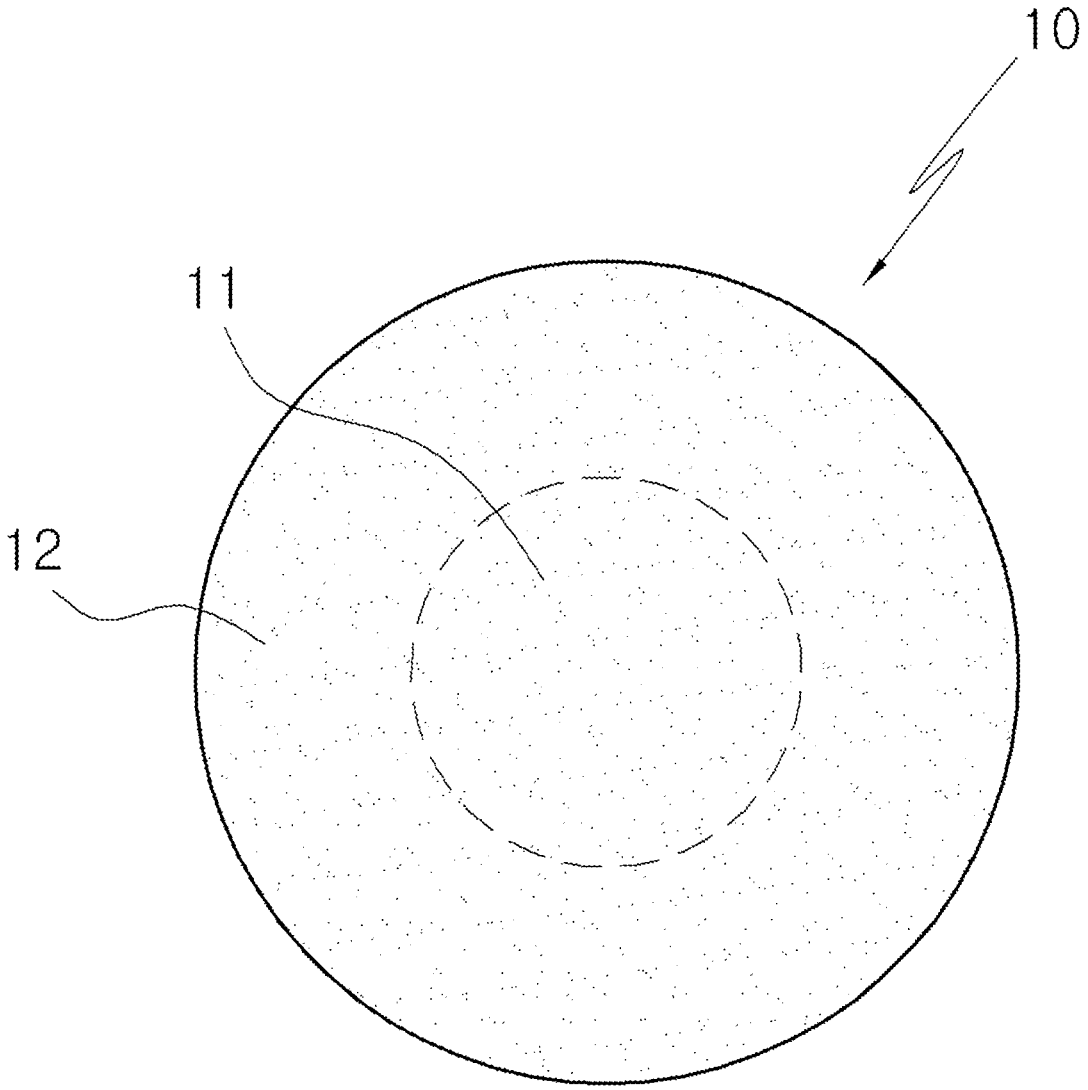
FIG. 6 is a view showing an example of a magnetic body applied to the launching apparatus according to the present invention.

The magnetic body 10 revolves along the circumference of the acceleration pipe 100 due to a force (electromagnetic force) exerted thereto by the magnetic field formed by the stator 200, so the magnetic body may be made of a material having ferromagnetic properties so as to be influenced by the magnetic field. The magnetic body 10 may be entirely made of a material having a ferromagnetic properties, and as shown in FIG. 6, may be structured such that the core 11 having ferromagnetic properties is included therein, and a plurality of holes 12 is formed in a protective film. Here, the protective film 12 may be made of a material such as silicon or plastic, through which a magnetic force can pass. Moreover, the magnetic body may be in the form of a gel containing a material having ferromagnetic properties.

Figure 7:
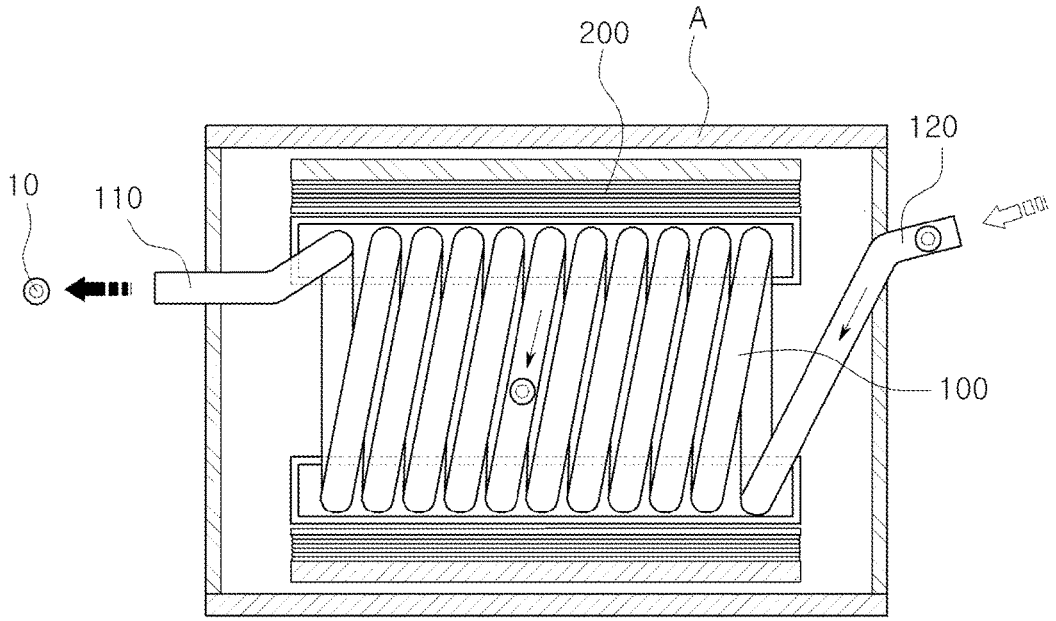
FIG. 7 is a view showing a process of moving the magnetic body in the launching apparatus according to the present invention.

A process in which the magnetic body 10 is launched through the present invention described above will be described. As shown in FIG. 7, when the stator 200 forms the magnetic field by being applied with the electric current and the magnetic body 10 is inserted through the inlet pipe 120, the magnetic body 10 revolves along the acceleration pipe 100 by the electromagnetic force under the influence of the magnetic field, whereafter the magnetic body 10, which is gradually accelerated, is launched outside through the outlet pipe 110.

According to the present invention, since the magnetic body 10 is launched after revolving due to the magnetic field formed by the magnetized stator 200, there is no need to use the gunpowder or compressed air to launch the magnetic body 10, thereby ensuring safety. In addition, it is possible to launch the magnetic body 10 at high speed while minimizing energy consumption, thereby enabling increased utilization in various fields.

Figure 8:
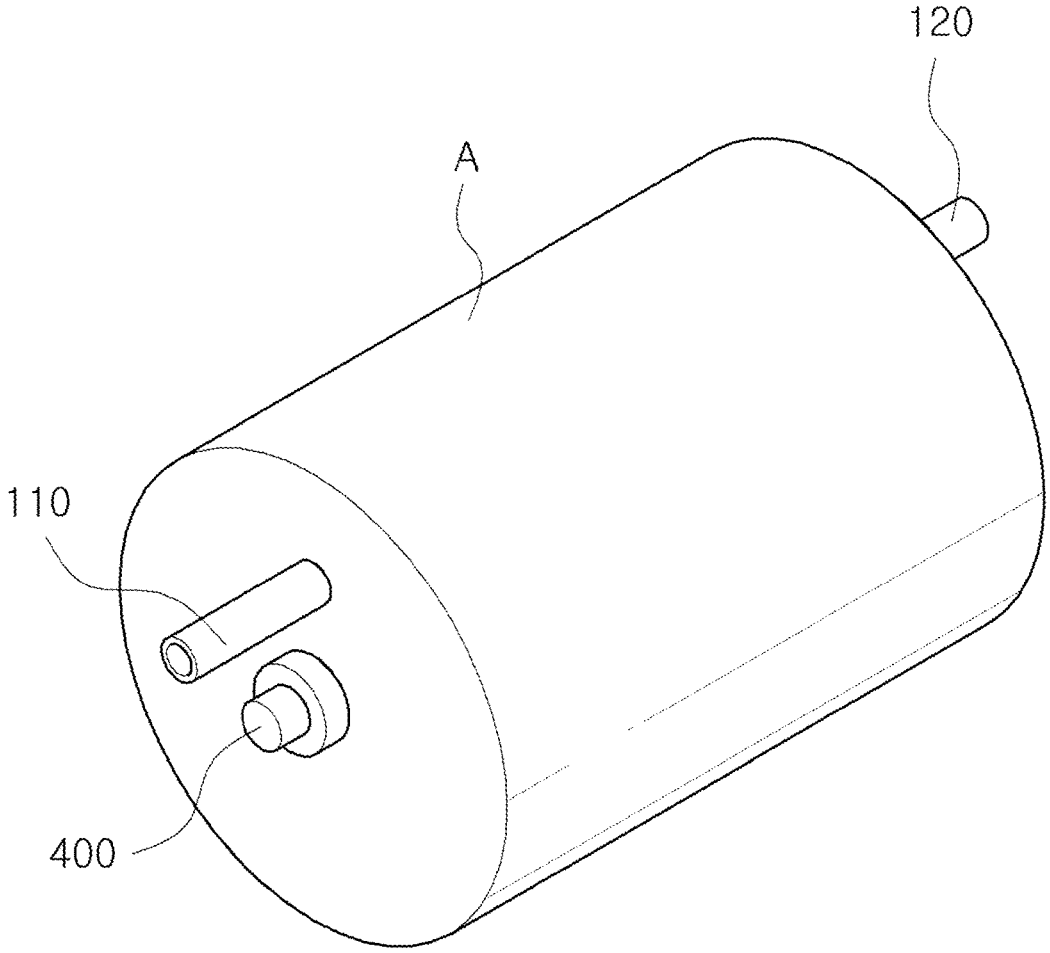
FIG. 8 and FIG. 9 are views showing another embodiment of the launching apparatus according to the present invention.
Figure 9:
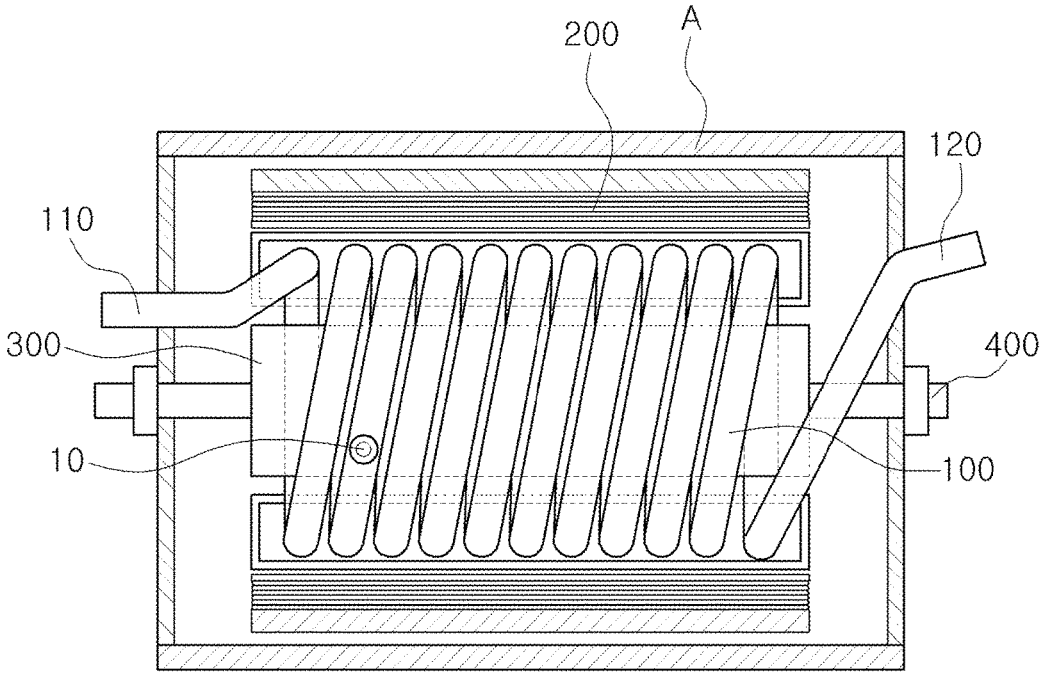

Meanwhile, as shown in FIGS. 8 and 9, a rotor 300 may be provided inside the stator 100, and the rotor 300 is coupled with a shaft 400 provided inside the acceleration pipe 100 in the lengthwise direction thereof and is rotated about the shaft. The rotor 300 may be provided inside the acceleration pipe 100 as shown in FIG. 9, or although not shown in the drawing, may be provided at a side or opposite sides of the acceleration pipe 100 to generate a rotational force. According to the present invention, it is possible to launch the magnetic body 10 and to transmit the rotational force to a load provided at a side or opposite sides of the shaft 400 at the same time, thereby enabling increased utilization. In addition, the rotor 300 may include a plurality of permanent magnets or iron, whereby it is possible for the rotor 300 to solve the problem of overheating the coils constituting the stator 200. Additionally, a viscous fluid composed of heating medium oil is readily used for lubrication and heat transfer.

The present invention described above can be applied to various purposes in various forms such as a form that is mounted in a vehicle, or a form that can be carried by a person, and can be applied to a technical field in which a magnetic body is launched or injected.

<Description of the Reference Numerals in the Drawings>

| | | | |
|---|---|---|---|
| A: | housing | 10: | magnetic body |
| 100: | acceleration pipe | 110: | outlet pipe |
| 120: | inlet pipe | 200: | stator |
| 300: | rotor | 400: | shaft |

What is claimed is:

1. A launching apparatus using a revolving magnetic body, the apparatus comprising:

an acceleration pipe (100) formed by winding a hollow pipe made of a non-magnetic material;

a stator (200) wound with a plurality of coils to encompass an outside of the acceleration pipe (100), and forming a magnetic field by being magnetized when an electric current is applied thereto; and a magnetic body (10) launched outside after revolving around a circumference of the acceleration pipe (100) due to a force exerted thereto by the magnetic field, wherein a rotor (300) is provided inside the acceleration pipe (100) and is rotated about a shaft (400) provided therein, so that a rotational force of the rotor (300) is usable.

2. The apparatus of claim 1, wherein the coils wound on the stator (200) form one pole, wherein the pole is formed of 2n in number, where n is an integer, such that speed of revolution of the magnetic body (10) is adjusted depending on the number of the poles.

3. The apparatus of claim 1, further comprising a regulator regulating frequency of the electric current applied to the stator (200), such that speed of revolution of the magnetic body (10) is adjusted.

4. The apparatus of claim 1, wherein the acceleration pipe (100) is provided at an end thereof with an outlet pipe (110)

through which the magnetic body (10) is launched outside, the outlet pipe (110) being provided with a helical groove formed on an inner surface thereof.

5. The apparatus of claim 4, wherein a certain portion of the outlet pipe (110) is made of a flexible material such that the outlet pipe is directed to a direction in which the magnetic body (10) is launched.

6. The apparatus of claim 1, wherein the rotor (300) includes any one of a plurality of permanent magnets and iron.

7. The apparatus of claim 5, wherein a viscous fluid composed of heating medium oil is readily used for lubrication and heat transfer.

* * * * *